US008670692B2

(12) United States Patent
Kusukawa

(10) Patent No.: US 8,670,692 B2
(45) Date of Patent: Mar. 11, 2014

(54) PHOTOSENSITIVE CONDUCTOR UNIT AND IMAGE FORMING APPARATUS

(75) Inventor: Takashi Kusukawa, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 197 days.

(21) Appl. No.: 13/306,312

(22) Filed: Nov. 29, 2011

(65) Prior Publication Data

US 2012/0134711 A1 May 31, 2012

(30) Foreign Application Priority Data

Nov. 30, 2010 (JP) ..... 2010-267339

(51) Int. Cl.
*G03G 21/18* (2006.01)

(52) U.S. Cl.
USPC ..... 399/114

(58) Field of Classification Search
USPC ..... 399/114
See application file for complete search history.

(56) References Cited

U.S. PATENT DOCUMENTS

2009/0297219 A1* 12/2009 Yoshino et al. ..... 399/114

FOREIGN PATENT DOCUMENTS

| | | |
|---|---|---|
| JP | S57-200051 | 12/1982 |
| JP | S62-156669 | 7/1987 |
| JP | H06-87177 B | 11/1994 |
| JP | 8-220939 | 8/1996 |
| JP | H08-292706 | 11/1996 |
| JP | 2009-268323 | 12/2009 |

OTHER PUBLICATIONS

JP Application No. 2010-267339 mailed Feb. 19, 2013.

* cited by examiner

*Primary Examiner* — Walter L Lindsay, Jr.
*Assistant Examiner* — Barnabas Fekete
(74) *Attorney, Agent, or Firm* — Dilworth & Barrese, LLP.

(57) ABSTRACT

The photosensitive conductor unit includes a casing, and a protective cover, wherein: the casing includes an engaging portion on an insertion-side end and a guide portion slidably guiding the protective cover in proximity to an opposite end to the insertion-side end of the photosensitive conductor unit; the protective cover includes a hook portion engaging with the engaging portion, a positioning portion determining the position of the protective cover, a side wall covering an exposed portion of the surface by extending along an axial direction of the photosensitive conductor drum, and a rail portion extending in the insertion direction of the photosensitive conductor unit in proximity to both ends of the side wall in a direction orthogonal to the axial direction of the photosensitive conductor drum and engaging with the guide portion such that the guide portion slidably guides the protective cover.

6 Claims, 7 Drawing Sheets

PHOTOSENSITIVE CONDUCTOR UNIT AND IMAGE FORMING APPARATUS

This application is based on and claims the benefit of priority from Japanese Patent Application No. 2010-267339, filed on 30 Nov. 2010, the content of which is incorporated herein by reference.

BACKGROUND OF THE DISCLOSURE

1. Field of the Disclosure

The present disclosure relates to a photosensitive conductor unit detachably mounted (exchangeable) on an image forming apparatus main body and including a casing that rotatably retains a photosensitive drum, and to an image forming apparatus including the photosensitive conductor unit.

2. Related Art

Conventionally, an image forming apparatus is known in which a toner cartridge that retains a photosensitive conductor drum in an integrated rotatable configuration is used in a relatively small monochromatic printer or the like, and a photosensitive conductor drum unit that retains a charging device or a static eliminator apparatus or the like that includes a photosensitive conductor drum in an integrated configuration is used in a relatively large monochromatic device or host apparatus such as a full-color printer or the like. The toner cartridge or the photosensitive conductor unit is exchanged depending on the product lifespan or the like, and is slidably inserted into the image forming apparatus main body to facilitate maintenance.

For example, when using a configuration in which a photosensitive conductor unit is inserted by opening an upper cover of the image forming apparatus main body, the photosensitive conductor unit can be mounted in a predetermined position in the image forming apparatus main body with a short insertion stroke and by substantially simultaneously determining the position of both longitudinal ends of the photosensitive conductor unit. Moreover, a protective cover that protects the surface of the photosensitive conductor drum can be easily opened by use of a drive mechanism or the like for the photosensitive conductor drum that is operably in conjunction with the insertion operation of the photosensitive conductor unit.

On the other hand, when using a configuration in which the photosensitive conductor unit is inserted by opening a front cover of the image forming apparatus main body, since the insertion stroke is long and the position of only one longitudinal end of the photosensitive conductor unit can be supported, the photosensitive conductor unit tends to move during the insertion operation, and the protective cover that protects the surface of the photosensitive conductor drum cannot be opened until insertion is completed.

Moreover, since the opening direction of the protective cover intersects with the insertion direction of the photosensitive conductor unit, ensuring a space for an opening operation for the protective cover in proximity to the transfer unit disposed in close association with the transfer roller or the like is extremely difficult.

In this context, a sliding-insertion configuration of photosensitive conductor unit is inserted into the image forming apparatus main body after removal of the protective cover from the photosensitive conductor unit.

However, in the above photosensitive conductor unit, during insertion into the image forming apparatus main body, since the photosensitive conductor drum is exposed, the photosensitive conductor drum tends to deviate in a vertical or lateral direction during the sliding insertion. As a result, there is the problem that the photosensitive conductor drum tends to be damaged.

SUMMARY OF THE DISCLOSURE

It is therefore an object of the present disclosure to provide a photosensitive conductor unit that enables protection of the surface of the photosensitive conductor drum until completion of an insertion operation of the photosensitive conductor unit into the image forming apparatus main body, and that enables simple detachment of a protective cover with reference to the direction of sliding during insertion of the unit, and to provide an image forming apparatus that includes the photosensitive conductor unit.

The photosensitive conductor unit according to the present disclosure includes a casing rotatably retaining a photosensitive conductor drum, and a protective cover for protecting at least a portion of the surface of the photosensitive conductor drum that is exposed from the casing, the protective cover detachably attached to the casing, in which: the casing includes an engaging portion on an end in axial direction of the photosensitive conductor drum to the image forming apparatus main body and a guide portion that slidably guides the protective cover in proximity to the end opposite to the engaging portion in axial direction of the photosensitive conductor drum; and the protective cover includes a hook portion that engages with the engaging portion, a positioning portion formed in proximity of the engaging portion to determine the position of the protective cover, a side wall covering an exposed portion of the surface by extending along an axial direction of the photosensitive conductor drum, and a rail portion extending along an axial direction of the photosensitive conductor drum in proximity to both ends of the side wall in a direction orthogonal to the axial direction of the photosensitive conductor drum and engaging with the guide portion such that the guide portion slidably guides the protective cover.

The photosensitive conductor unit according to the present disclosure uses a simple configuration to protect the surface of a photosensitive conductor drum until completion of insertion of the photosensitive conductor unit into the image forming apparatus main body, and enables detachment of the protective cover with reference to the direction of sliding during insertion of the unit.

DETAILED DESCRIPTION OF THE DISCLOSURE

Next, a photosensitive conductor unit according to the first embodiment of the present disclosure will be described making reference to the figures. The examples described hereafter are preferred examples of the photosensitive conductor unit according to the present disclosure and may include various preferred technical limitations. However, the technical scope of the present disclosure is not limited to such configurations in the absence of a specific limitation in relation to the present disclosure. Furthermore, the constituent elements in the embodiments described below may be suitably exchanged with existing constituent elements or the like, and a range of variations including combinations with other existing constituent elements is possible. Consequently, the description of the following embodiments is not limited to the details of the disclosure as recited in the scope of the patent claims.

Figure 1:
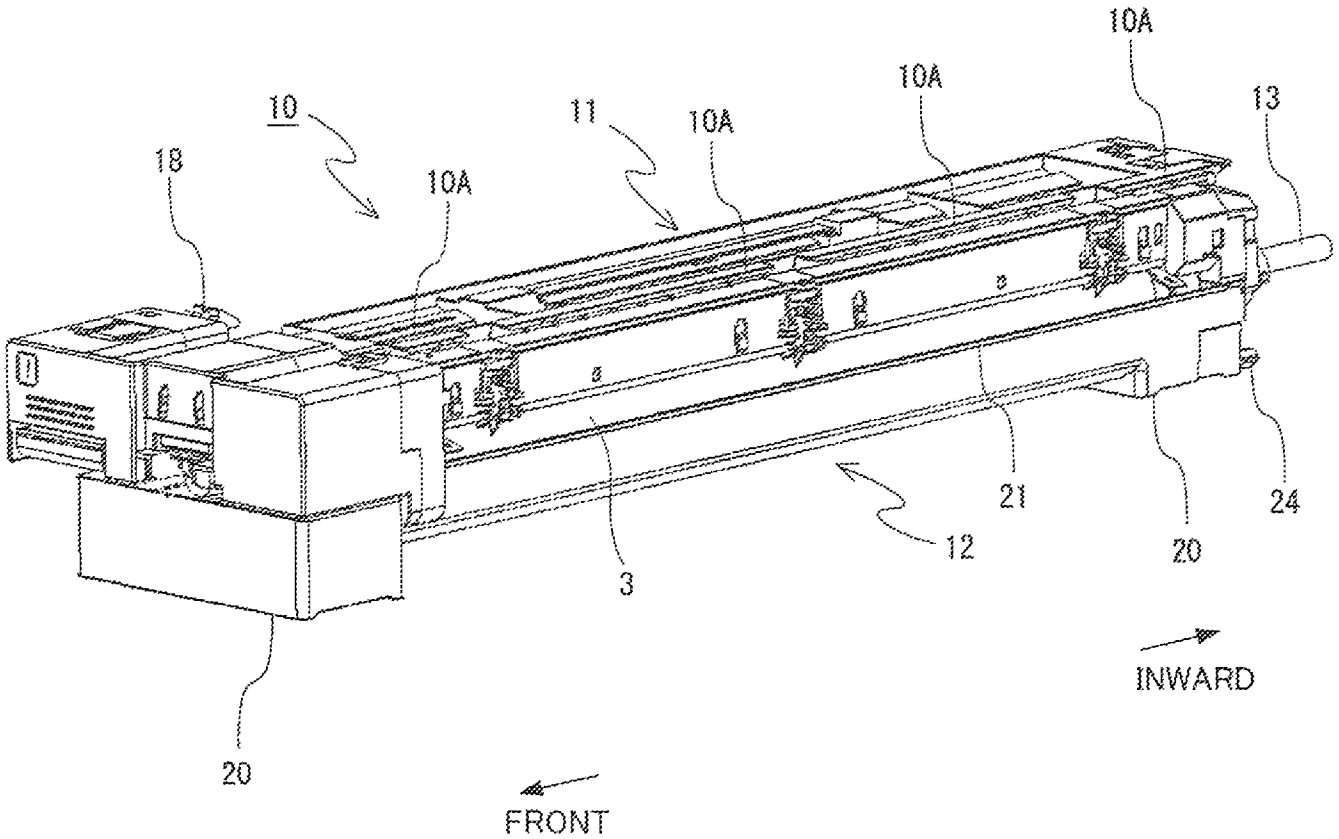
FIG. 1 is a perspective view of a photosensitive conductor unit according to a first embodiment of the present disclosure.
Figure 2:
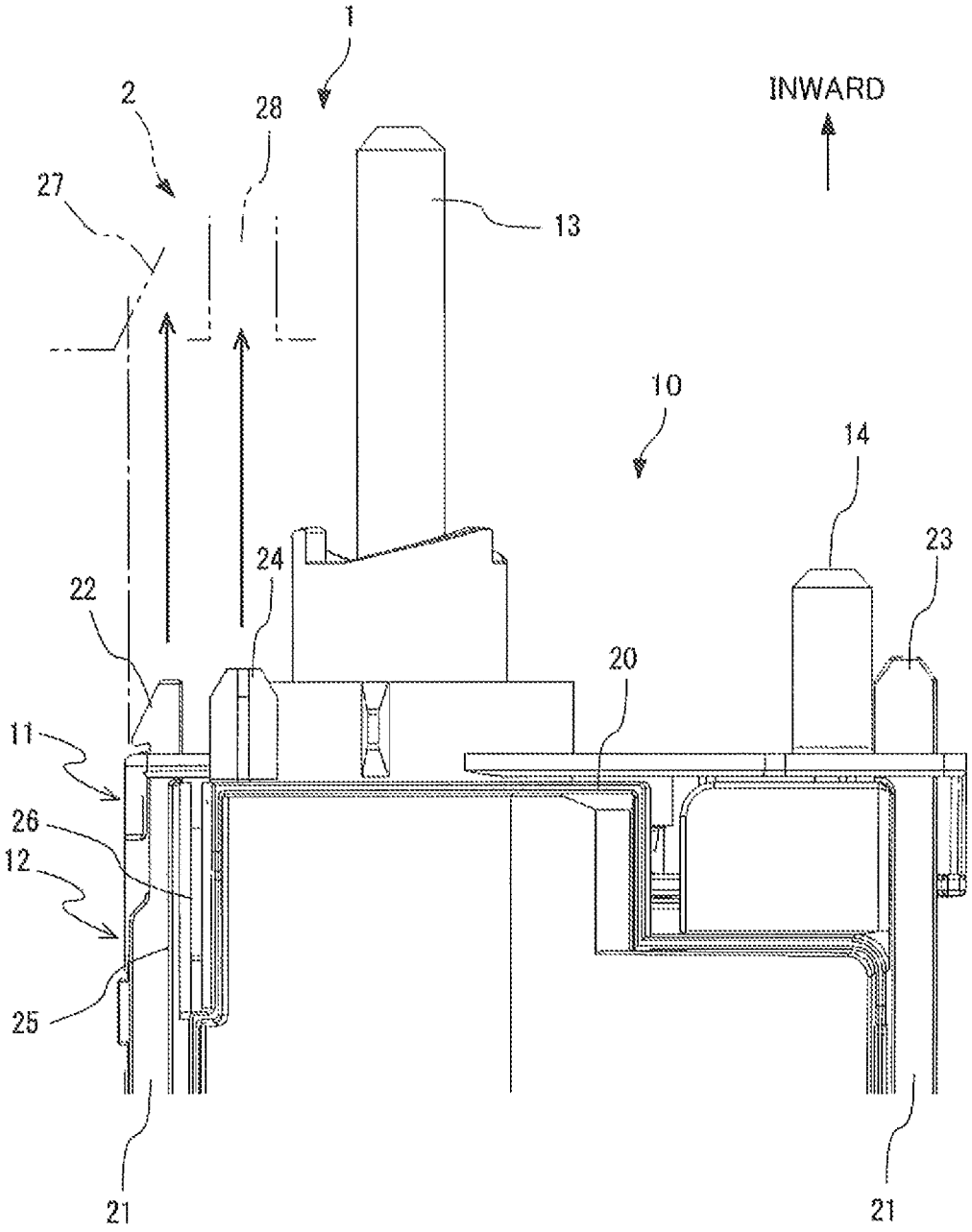
FIG. 2 is a bottom view of the inner portion of a photosensitive conductor unit according to the first embodiment of the present disclosure.
Figure 3:
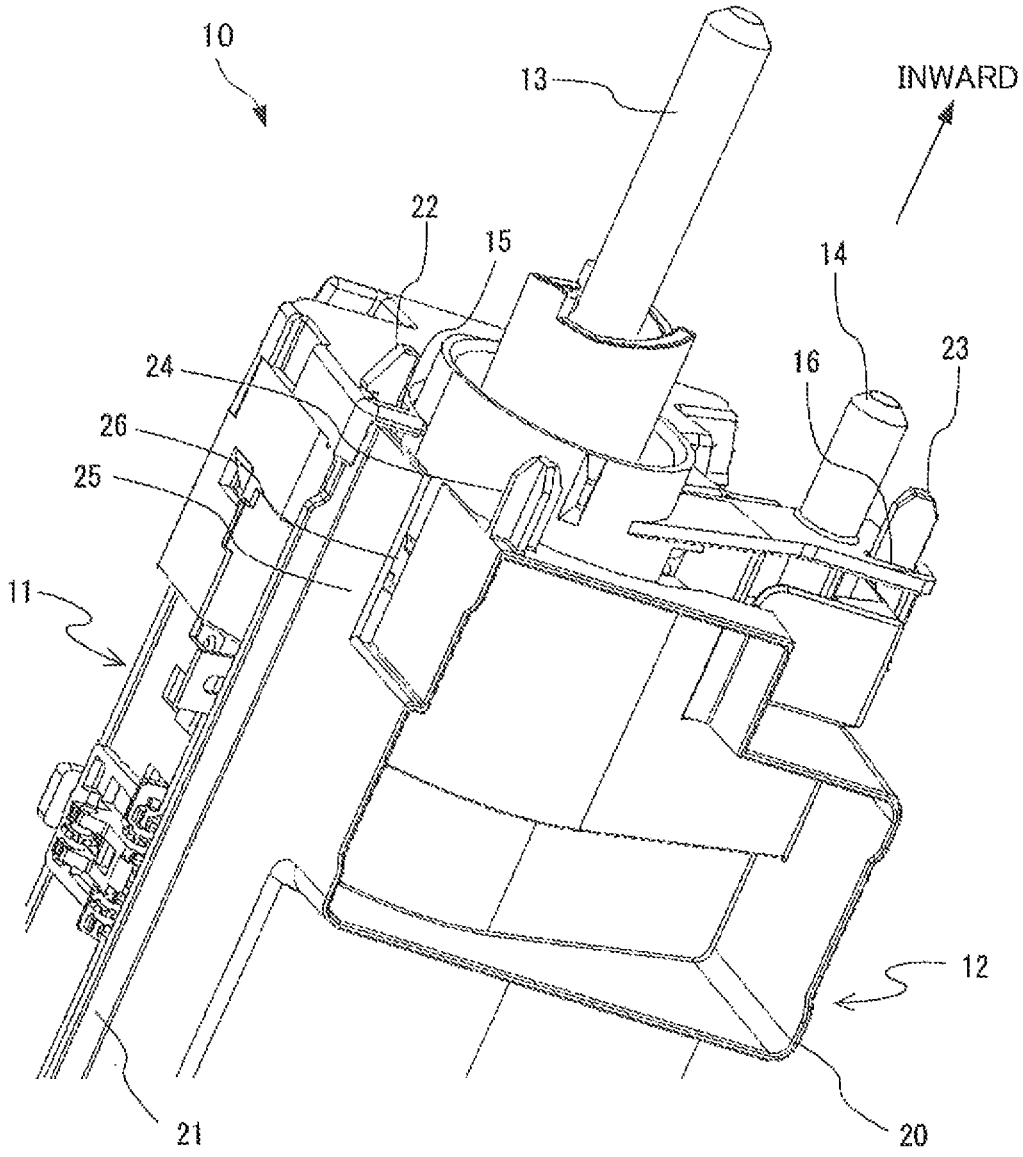
FIG. 3 is a perspective view seen from the bottom of the inner portion of a photosensitive conductor unit according to the first embodiment of the present disclosure.
Figure 4:
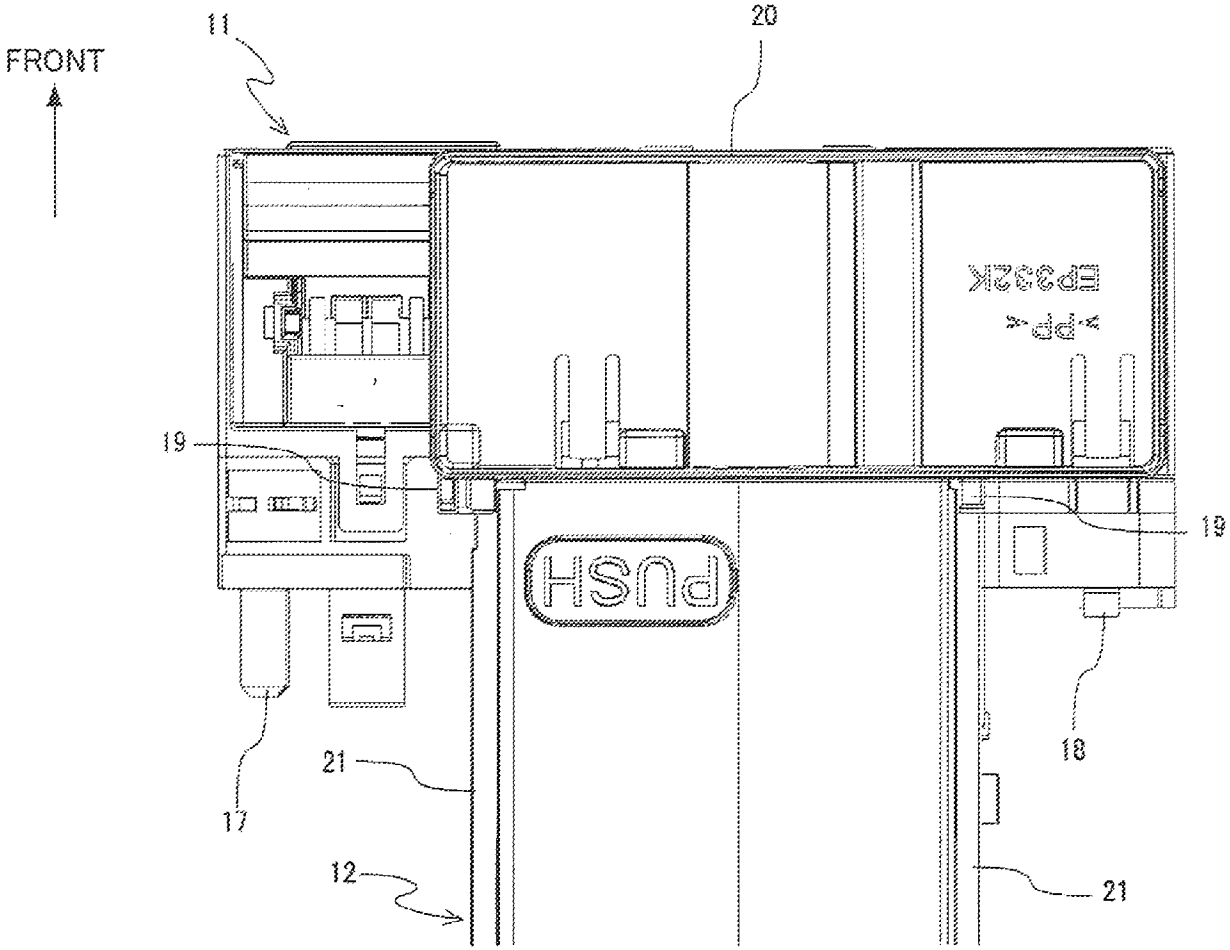
FIG. 4 is a bottom view of the front portion of a photosensitive conductor unit according to the first embodiment of the present disclosure.
Figure 5:
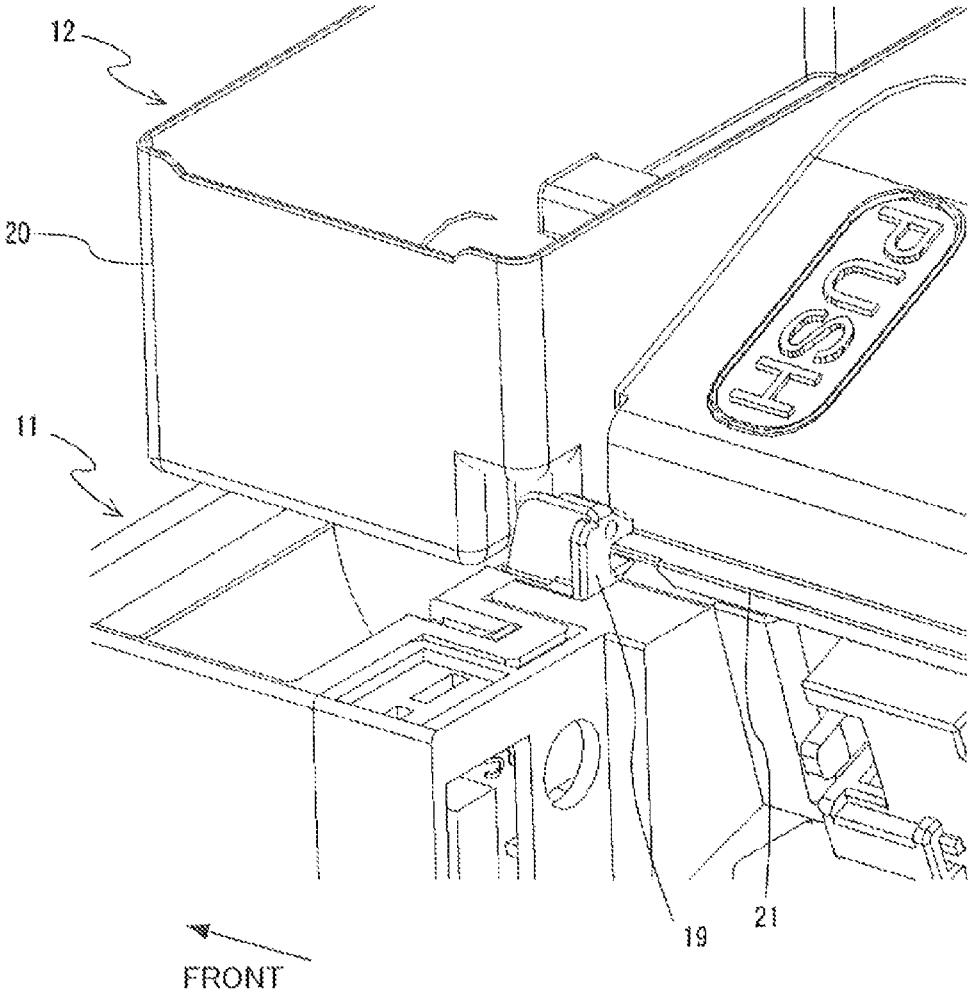
FIG. 5 is a perspective view seen from the bottom of the front portion of a photosensitive conductor unit according to the first embodiment of the present disclosure.
Figure 6:
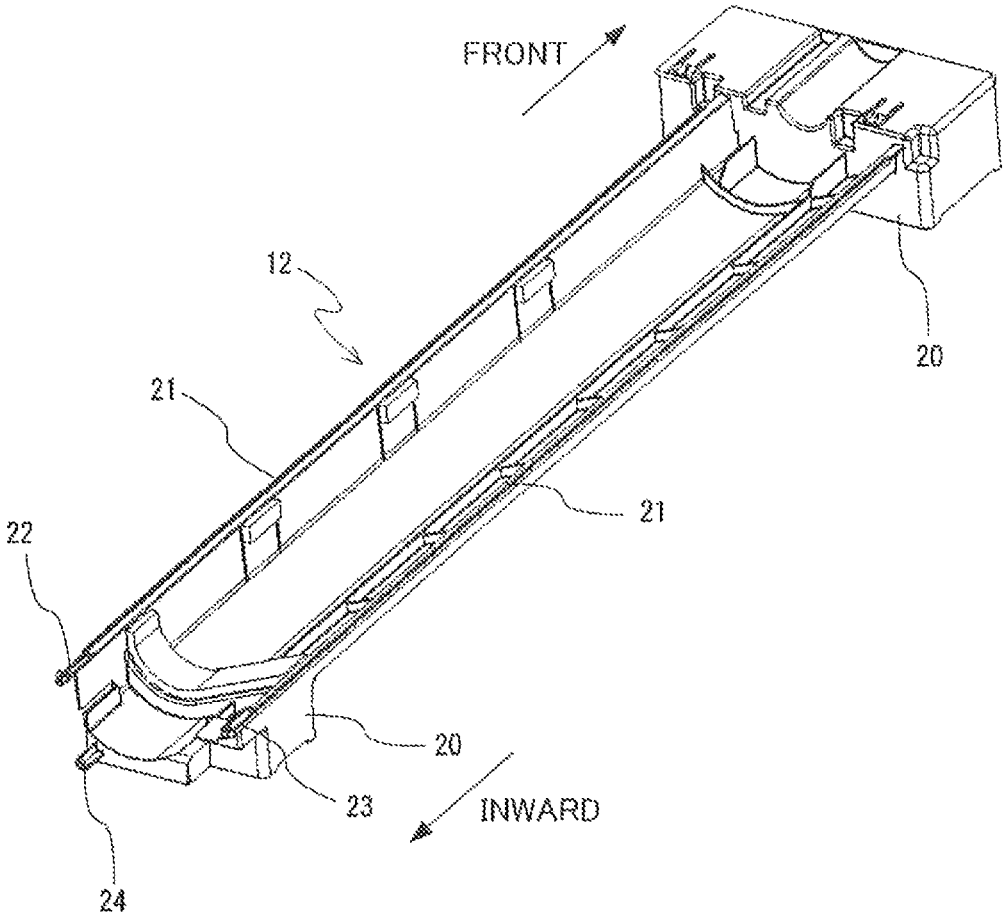
FIG. 6 is a perspective view of a protective cover in the photosensitive conductor unit according to the first embodiment of the present disclosure.
Figure 7:
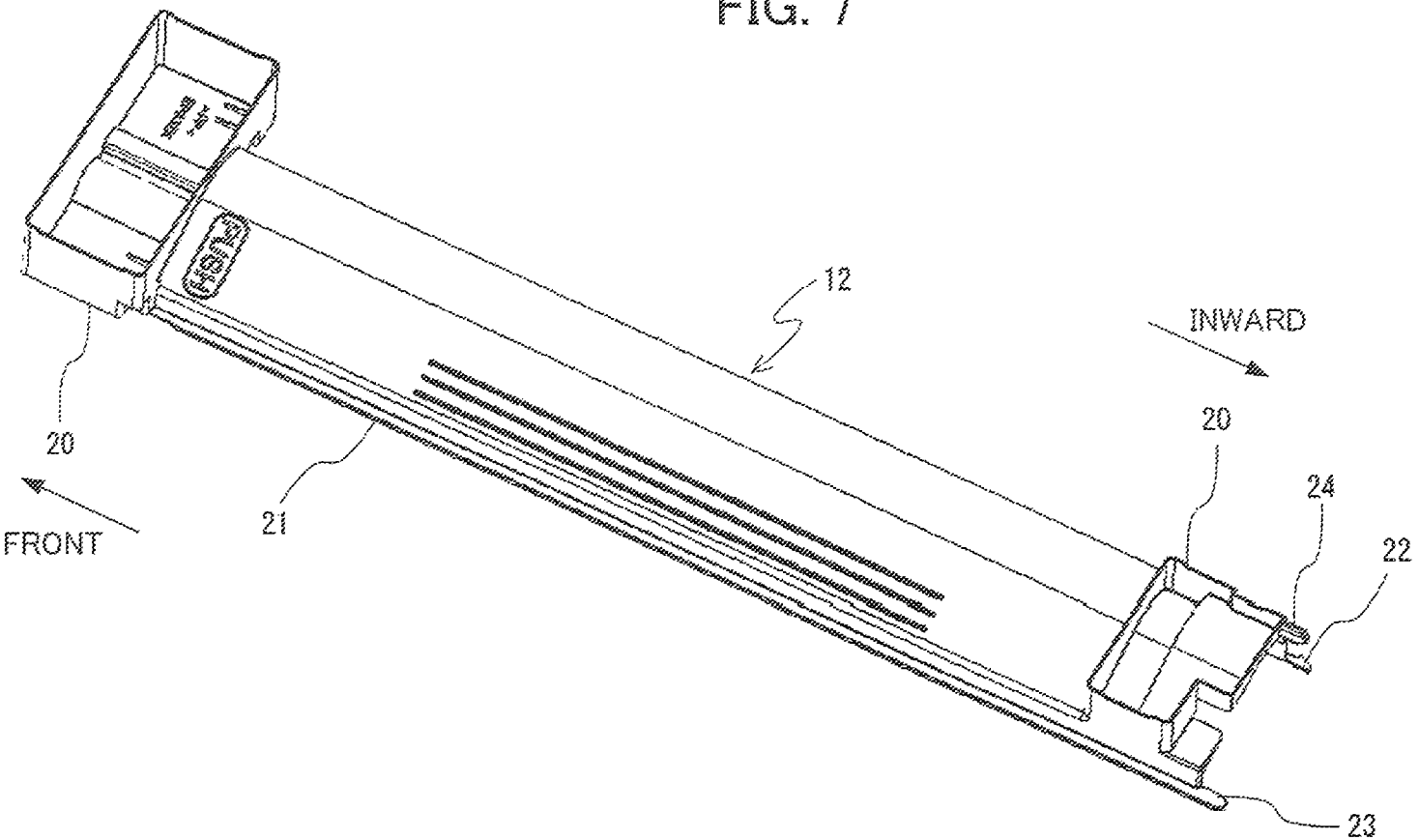
FIG. 7 is a perspective view of the bottom side of the protective cover in the photosensitive conductor unit according to the first embodiment of the present disclosure.

FIG. 1 is a perspective view of a photosensitive conductor unit according to a first embodiment of the present disclosure. FIG. 2 is a bottom view of the inner portion of a photosensitive conductor unit according to the first embodiment of the present disclosure. FIG. 3 is a perspective view seen from the bottom of the inner portion of a photosensitive conductor unit according to the first embodiment of the present disclosure. FIG. 4 is a bottom view of the front portion of a photosensitive conductor unit according to the first embodiment of the present disclosure. FIG. 5 is a perspective view seen from the bottom of the front portion of a photosensitive conductor unit according to the first embodiment of the present disclosure. FIG. 6 is a perspective view of a protective cover in the photosensitive conductor unit according to the first embodiment of the present disclosure. FIG. 7 is a perspective view of the bottom side of the protective cover in the photosensitive conductor unit according to the first embodiment of the present disclosure.

As illustrated in FIG. 2, the image forming apparatus 1 includes an image forming apparatus main body 2, and a photosensitive conductor unit 10 that can be detachably attached to the image forming apparatus main body 2 by sliding along an axial direction of a photosensitive conductor drum 3 (refer to FIG. 1). The axial direction of the photosensitive conductor drum 3, the sliding (insertion) direction of the photosensitive conductor drum 10, and the longitudinal direction of the photosensitive conductor drum 10 coincide.

In FIG. 1, the photosensitive conductor unit 10 includes a casing 11 that rotatably retains the photosensitive conductor drum 3, and a protective cover 12 that is detachably retained on the casing 11. The photosensitive conductor unit 10 is inserted into an inner portion of the image forming apparatus main body 2 from the front surface (front side) of the image forming apparatus main body 2 (refer to FIG. 2), that is to say, in an orthogonal direction to the direction of conveyance of the transfer paper (the longitudinal direction of the photosensitive conductor unit 10). In the following description, in a configuration in which the photosensitive conductor unit 10 is attached to the image forming apparatus main body 2, the end of the photosensitive conductor unit 10 positioned on the front side of the image forming apparatus main body 2 (the end on the opposite side to the end on the insertion side) is defined as the "front" end, and the end positioned on the inward side of the image forming apparatus main body 2 (the insertion-side end) is defined as the "inward" end.

Casing 11

The casing 11 is configured from a hard resin such as polypropylene or the like. As illustrated in FIG. 2 and FIG. 3, a rotation shaft 13 of the photosensitive conductor drum 3 (refer to FIG. 1) projects in an inward direction from the inward end of the casing 11. The casing 11 forms an inward positioning boss 14 that projects inwardly. The position of the inward positioning boss 14 is determined on an inward side of the casing 11 in coordination with the rotation shaft 13 by engagement with a positioning hole (not shown) provided on an inward side of the image forming apparatus main body 2. Furthermore, two slits 15, 16 are formed as an engaging portion about both ends in the short dimension direction on the inward end face of the casing 11.

As illustrated in FIG. 4, a front positioning boss 17 is formed on the casing 11 to project inwardly and thereby determine the position of the front side of the photosensitive conductor unit 10 and the image forming apparatus main body 2. Each boss 14, 17 may fix a metallic component to the casing 11. A wedge-shaped hook 18 is formed on the casing 11 to engage with and prevent detachment from the image forming apparatus main body 2. A pair of C-shaped guide portions 19 when viewed from the front or inward side is formed on the casing 11 in proximity to both front ends in the short dimension direction. The front positioning boss 17, the hook 18 and the guide portion 19 are provided in proximity to the opposite (front) end to the insertion-side end of the photosensitive conductor unit 10. The guide portion 19 engages with a guide rail (rail portion) 21 (described below) of the protective cover 12 to enable slidable guiding of the protective cover 12.

Protective Cover 12

The protective cover 12 is configured from a hard resin such as polypropylene or the like. A side wall 25 extends in the longitudinal direction along the axial direction of the photosensitive conductor drum 3. The side wall 25 covers the whole surface of the portion of the photosensitive conductor drum 3 that is exposed from the casing 11. As illustrated in FIG. 6 and FIG. 7, respective leg portions 20 are formed on the lower surface of both longitudinal ends on the protective cover 12. The leg portions 20 are provided on an outer surface in proximity to both ends of the side wall 25 along the axial direction of the photosensitive conductor drum 3. A pair of flange-shaped guide rails (rail portion) 21 is provided on the protective cover 12. The guide rail 21 extends along the longitudinal direction of the photosensitive conductor unit 10 (the insertion direction of the photosensitive conductor unit) in proximity to both ends of the side wall 25 in a direction that is orthogonal to the axial direction of the photosensitive conductor drum 3.

The inward end of the protective cover 12 integrates the thin wedge-shaped fixed hook portion (hook portion) 22, the thin tongue-shaped engaging hook portion (hook portion) 23, and the positioning boss (positioning portion) 24 that is elongated towards the tip. The fixed hook portion 22, the engaging hook portion 23, and the positioning boss 24 project in an inward direction.

Leg Portion 20

The leg portion 20 includes a rectangular open edge portion that is opened towards the bottom surface of the photosensitive conductor unit 10. The leg portion 20 can be disposed on a flat surface such as a table in a configuration in which the photosensitive conductor unit 10 with the protective cover 12 attached thereto is attached to the image forming apparatus main body 2 by positioning the open edge portion on the same flat surface. In the same manner, after removal of a new photosensitive conductor unit 10 from the package, the photosensitive conductor unit 10 with the new protective cover 12 attached thereto can be temporarily disposed on a flat surface such as a table or the like during an exchange operation such as removal of the old photosensitive conductor unit from the image forming apparatus main body 2. Furthermore, the photosensitive conductor unit 10 can be attached to the image forming apparatus main body 2 without re-handling from that disposed configuration. The leg portion 20 can adopt an open edge portion shape that enables disposition of the photosensitive conductor unit 10 on a table or the like in a configuration approximating attachment to the image forming apparatus main body 2. In this manner, the sliding configuration of the photosensitive conductor unit 10 during actual attachment to the image forming apparatus main body 2 enables comprehend sensuously in advance.

Guide Rail 21

The guide rail 21 is engaged with the guide portion 19 formed on a front side of the casing 11 so as to slidably guide the protective cover 12. In this manner, the protective cover 12 is retained in a slidable configuration enabling that prevents detachment from the photosensitive conductor unit 10. The guide rail 21 is formed across the longitudinal direction of the protective cover 12, and therefore support of the protective cover 12 in a protected configuration until completion of attachment of the photosensitive conductor unit 10 is enabled.

Fixed Hook Portion 22

The fixed hook portion 22 passes through a slit 15 formed on the inward end face of the casing 11 to engage in a projecting configuration that prevents detachment. The fixed hook portion 22 is formed on an upper end of the side wall 25 that extends in the direction of sliding of the protective cover 12. A slit 26 extending in the direction of sliding is formed below the side wall 25. In this manner, unforeseen detachment (separation) of the protective cover 12 from the casing 11 can be prevented.

The hook guide portion 27 is formed on the front wall face of the image forming apparatus main body 2, and has a rib-shape that inclines so that interference with the side wall 25 of the protective cover 12 increases along an inward direction. When attaching the photosensitive conductor unit 10 to the image forming apparatus main body 2, the hook guide portion 27 comes into contact with a portion between the fixed hook portion 22 and the slit 26 in the side wall 25 of the protective cover 12 to thereby bend the side wall 25 inside at a predetermined position immediately after attachment to the main body. In this manner, the engagement of the fixed hook portion 22 and the casing 11 is released.

Engaging Hook Portion 23

The engaging hook portion 23 passes through the slit 16 formed in the inward end face of the casing 11, and includes a positioning function of the inward side of the protective cover 12 in relation to the casing 11. The engaging hook portion 23 enables displacement of the protective cover 12 in a sliding direction when attaching the protective cover 12 to the casing 11, and prevents detachment of the protective cover 12 from the casing 11 during attachment.

Positioning Boss 24

The tip of the positioning boss 24 is formed in an elongated configuration to thereby form a distal shape in a + shape, the shape of a crosshead screwdriver. When the photosensitive conductor unit 10 is attached to the image forming apparatus main body 2, the positioning boss 24 engages with a positioning indentation 28 (positioning concave) formed on the inward wall face of the image forming apparatus main body 2 in a predetermined position prior to abutment of the side wall 25 of the protective cover 12, immediately after attachment, with the hook guide portion 27 of the image forming apparatus main body 1. This engagement determines the position of the protective cover 12 with respect to the image forming apparatus main body 2. Even when the side wall 25 of the protective cover 12 abuts with the hook guide portion 27 of the image forming apparatus main body 2, the protective cover 12 does not move, and engagement of the fixed hook portion 22 is released by bending of the side wall 25.

Embodiments

Using the configuration described above, the front cover (not shown) of the image forming apparatus main body 2 is released, and after removing the old photosensitive conductor unit (without protective cover), the photosensitive conductor unit 10 is inserted from the its inward side. When attaching the photosensitive conductor unit 10 to the image forming apparatus main body 2, the guide 10A engages with the guide groove (not shown) provided on the image forming apparatus main body 2 and therefore the photosensitive conductor unit 10 has an insertion/guide function for guiding its insertion. The guide groove provided on the image forming apparatus main body 2 is generally used even when attaching a known photosensitive conductor unit.

In the present embodiment, when attaching the photosensitive conductor unit 10 having the protective cover 12 attached thereto into an inner portion of the image forming apparatus main body 2, the position of the positioning boss 24 is determined by engagement with the positioning indentation 28 and the side wall 25 abuts with the hook guide portion 27. In this manner, the engagement between the fixed hook portion 22 and the slit 15 is released and the engagement of the engaging hook portion 23 and the slit 16 is released.

More specifically, firstly, insertion of the photosensitive conductor unit 10 commences in a configuration in which the position of the guide 10A of the photosensitive conductor unit 10 is determined by engagement with the guide groove provided on the image forming apparatus main body 2.

Then, immediately after commencement of insertion of the photosensitive conductor unit 10, the positioning boss 24 of the protective cover 12 is inserted into the positioning indentation 28 of the image forming apparatus main body 2, and the position of the protective cover 12 is determined. Next, the side wall 25 of the protective cover 12 bends into contact with the hook guide portion 27 of the image forming apparatus main body 2, and the engagement between the fixed hook portion 22 and the casing 11 is thereby released.

When the photosensitive conductor unit 10 is inserted by pressing along the guide groove, the inward end side of the protective cover 12 abuts with the front wall face of the image forming apparatus main body 2. At this time, the protective cover 12 does not move, and the photosensitive conductor unit 10 moves along the guide rail 21. After the protective cover 12 is pulled slight forward in a configuration in which the photosensitive conductor unit 10 has moved up to the attachment completion position, the positioning boss 24 is detached from the positioning indentation 28 of the image forming apparatus main body 2, the engagement between the guide rail 21 and the guide portion 19 is released, and a free configuration is enabled.

When the protective cover 12 is attached to the photosensitive conductor unit 10, the photosensitive conductor unit 10 is placed in an upward orientation, the guide rail 21 slides and is inserted from the inward side of the protective cover 12 into the guide portion 19 of the casing 11, and the fixed hook portion 22 and the engaging hook portion 23 are inserted into the slits 15, 16 acting as an engaging portion. In this manner, the protective cover 12 can be simply attached to the photosensitive conductor unit 10.

In this manner, in the photosensitive conductor unit 10 according to the present disclosure, when a user exchanges the photosensitive conductor unit 10, the photosensitive conductor drum is protected from external light or external shocks, and deterioration and the damage such as breakage or contamination of the photosensitive conductor drum can be prevented. Furthermore, during a series of operations by a user for attachment of the photosensitive conductor unit 10 to the image forming apparatus main body 2, the locking of the protective cover 12 and the casing 11 can be automatically released. As a result, a drawing-out operation of the protective cover 12 can be simply performed. When the old photosensitive conductor unit after exchange is returned to the manufacturer or the like, the removed protective cover 12 can be simply attached, and in the event that the old photosensitive conductor unit 10 is returned to the manufacturer or the like, recycling is possible.

What is claimed is:

1. A photosensitive conductor unit comprising:

a casing rotatably retaining a photosensitive conductor drum including an engaging portion on an end in axial direction of the photosensitive conductor drum, and a guide portion disposed in proximity to the end opposite to the engaging portion in axial direction of the photosensitive conductor drum; and a protective cover for protecting at least a portion of the surface of the photosensitive conductor drum that is exposed from the casing and detachably attached to the casing including a hook portion that engages with the engaging portion, a positioning portion formed in proximity of the engaging portion to determine the position of the protective cover, a side wall covering an exposed portion of the surface by extending along an axial direction of the photosensitive conductor drum, and a rail portion extending along an axial direction of the photosensitive conductor drum in proximity to both ends of the side wall in a direction orthogonal to the axial direction of the photosensitive conductor drum, and engaging with the guide portion such that the guide portion slidably guides the protective cover, wherein the photosensitive conductor unit is detachably attached and slides along an axial direction of the photosensitive conductor drum with respect to an image forming apparatus main body, the image forming apparatus main body includes a positioning indentation, and when attaching the photosensitive conductor unit to the image forming apparatus main body in a configuration in the protective cover has been attached to the photosensitive conductor unit, the position of the positioning portion is determined by engagement with the positioning indentation.

2. The photosensitive conductor unit according to claim 1, wherein the image forming apparatus main body includes a hook guide portion, and when attaching the photosensitive conductor unit to the image forming apparatus main body in a configuration in the protective cover has been attached to the photosensitive conductor unit, the engagement between the hook portion and the engaging portion is released by abutment of the side wall with the hook guide portion.

3. The photosensitive conductor unit according to claim 1, wherein the protective cover has respective leg portions on an outer surface in proximity to both ends of the side wall along the axial direction of the photosensitive conductor drum, and wherein the leg portions enable the photosensitive conductor unit with the protective cover attached thereto to be disposed on a flat surface.

4. An image forming apparatus comprising:

a image forming apparatus main body including a positioning indentation; and a photosensitive conductor unit having a photosensitive conductor drum, and detachably attached and sliding along an axial direction of the photosensitive conductor drum with respect to the image forming apparatus main body; wherein the photosensitive conductor unit comprises:

a casing rotatably retaining the photosensitive conductor drum in the photosensitive conductor unit including an engaging portion on an end in the insertion side when attaching the photosensitive conductor unit to the image forming apparatus main body, and a guide portion disposed in proximity to the end opposite to the insertion-side end of the photosensitive conductor unit; and a protective cover for protecting at least a portion of the surface of the photosensitive conductor drum that is exposed from the casing, and detachably attached to the casing including a hook portion that engages with the engaging portion, a positioning portion formed to determine the position of the protective cover immediately after starting of attachment when attaching to the image forming apparatus main body, a side wall covering an exposed portion of the surface by extending along an axial direction of the photosensitive conductor drum, and a rail portion extending in the insertion direction of the photosensitive conductor unit in proximity to both ends of the side wall in a direction orthogonal to the axial direction of the photosensitive conductor drum, and engaging with the guide portion such that the guide portion slidably guides the protective cover, wherein when attaching the photosensitive conductor unit to the image forming apparatus main body in a configuration in the protective cover has been attached to the photosensitive conductor unit, the position of the positioning portion is determined by engagement with the positioning indentation.

5. The image forming apparatus according to claim 4, wherein the image forming apparatus main body includes a hook guide portion, and when attaching the photosensitive conductor unit to the image forming apparatus main body in a configuration in the protective cover has been attached to the photosensitive conductor unit, the engagement between the hook portion and the engaging portion is released by abutment of the side wall with the hook guide portion.

6. The image forming apparatus according to claim 4, wherein the protective cover has respective leg portions on an outer surface in proximity to both ends of the side wall along the axial direction of the photosensitive conductor drum, and wherein the leg portions enable the photosensitive conductor unit with the protective cover attached thereto to be disposed on a flat surface in a configuration approximating attachment of the photosensitive conductor unit to the image forming apparatus main body.

* * * * *